US005386654A

United States Patent [19]

Kroenke

[11] Patent Number: 5,386,654

[45] Date of Patent: Feb. 7, 1995

[54] INTEGRATED CUTTING AND PRESSING BOARD INCLUDING MARKING SCALE ON THE HANDLE

[75] Inventor: June E. Kroenke, West Bend, Wis.

[73] Assignee: June Tailor Inc., Richfield, Wis.

[21] Appl. No.: 126,066

[22] Filed: Sep. 23, 1993

[51] Int. Cl.[6] ..... D06F 81/00; B26D 7/20; A41H 1/00

[52] U.S. Cl. ..... 38/141; 223/69; 33/11; 269/307

[58] Field of Search ..... 38/103, 104, 108, 111, 38/141; 16/110 R, 116 R; 223/69; 40/642; 33/1 G, 11, 12, 1 AA, 1 B, 623, 613, 483; 7/163, 164, 167, 170; 269/289 R, 302.1, 307

[56] References Cited

U.S. PATENT DOCUMENTS

| | | | |
|---|---|---|---|
| D. 142,608 | 10/1945 | Ziegfeld | 33/1 B X |
| 1,625,453 | 4/1927 | Capuano | 33/11 |
| 2,160,337 | 5/1939 | McKee | 38/141 |
| 2,655,188 | 10/1953 | Catching, Jr. | 269/307 |
| 3,473,245 | 10/1969 | Bailey et al. | 38/141 |
| 4,026,445 | 5/1977 | Poage | 223/69 |
| 4,171,573 | 10/1979 | Picciotto | 33/1 B |
| 4,192,494 | 3/1980 | Mima | 269/289 R |
| 4,335,533 | 6/1982 | Kroenke | 38/141 |
| 4,907,789 | 3/1990 | Tice | 269/302.1 X |
| 5,241,733 | 9/1993 | Rosen | 269/289 R X |

OTHER PUBLICATIONS

June Taylor, I ♡ ("LOVE") Quilting Supplies, I ♡ Quilting Kit, Rotary Cutting Mat, Model JT-760.

*Primary Examiner*—Clifford D. Crowder
*Assistant Examiner*—Ismael Izaguirre
*Attorney, Agent, or Firm*—Andrus, Sceales, Starke & Sawall

[57] ABSTRACT

An integrated cutting and pressing board unit is for cutting, blocking and pressing of fabric parts for sewing together. A relatively flat cutting mat is formed of a solid plastic with a front face and a back face. A cushioned pressing board unit is intimately interconnected to the back face of the mat. The pressing board includes a support plate and an outer resilient pad interconnected to the support plate and an outer cover enclosing said plate and pad. The mat's front face and the outer cover each including a grid pattern with measuring indicia on the edges. The cover is formed of a fabric extended over the outer surface of the pad and board wrapped about the edges and interposed between the cutting mat and the pressing board unit. A handle extends outwardly one edge of the mat. The handle includes a hand opening including spaced edges. The handle opening has parallel edges spaced outwardly of the mat grid pattern and the pressing board unit. The parallel edges have a linear extent of at least about six inches and are connected by curved ends. The spaced and end edges are marked on the back of the mat with metric measurements along a first edge and decimal measurement markings along the second edge.

19 Claims, 2 Drawing Sheets

FIG. 2
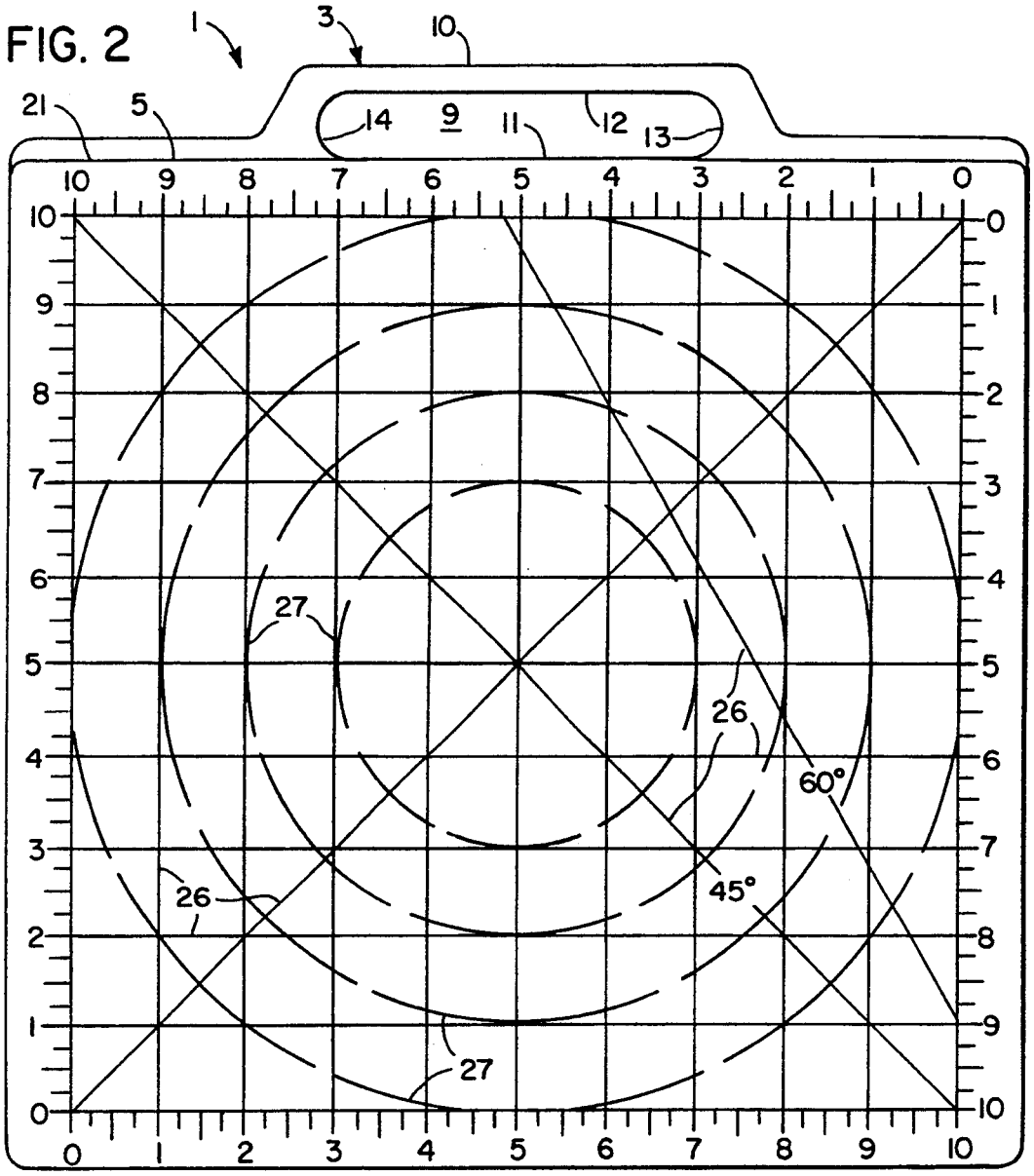
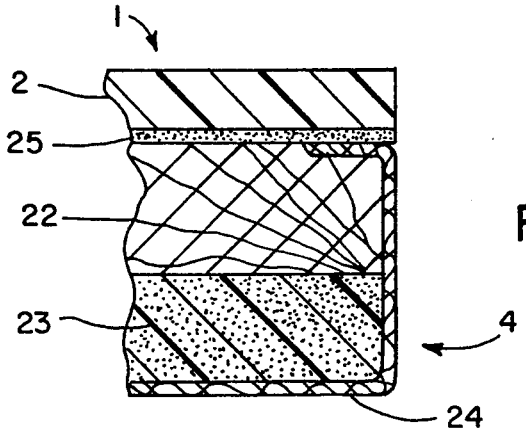
FIG. 4

INTEGRATED CUTTING AND PRESSING BOARD INCLUDING MARKING SCALE ON THE HANDLE

BACKGROUND OF THE INVENTION

The present invention relates to a combined cutting board for cutting of fabric to predetermined configurations and elements and pressing of such fabric elements for quilting and the like.

In forming of fabric products, such as quilting, needlework and the like, a base fabric may be formed into a particular configuration for use in forming of a quilt or other article. Various cutting mats have long been made available, with various marking indicia on the one face of the cutting mat. The quilter cuts individual fabric pieces or elements from a large fabric piece and sews such elements to form an outer quilt cover. The cutting mat has indicia for aligning and forming of the fabric for cutting of the individual pieces into the desired shape and size. The cutting mat preferably a solid board. The users lays the fabric on the board with the appropriate indicia aligned, and with a rotary or other cutter cut the fabric piece along the guide line to form the element of a particularly configuration, such as a rectangular, other multi-sided configuration including different angled edges, and even circles and the like. The present inventor has for a number of years sold a cutting mat having a special surface which is not cut during the cutting process and has a small handle for carrying and storing the mat. In addition, after forming and cutting of the fabric pieces to the desired shape, the elements may be sewn together to form a basic pattern element to be joined with other single or multi-piece elements in forming a cover. Further, before sewing the individually formed elements to each other, it is desirable to press or iron such elements. Generally, pressing is desirably provided on a cushioned board, which will eliminate seam edge impression, protect raised detail of fine applique and the like. Basically, a cushioned structure further voids undesirable flattened or shining surfaces. A satisfactory cushioned pressing board is shown in the applicant's previously issued U.S. Pat. No. 4,335,533 which issued Jun. 22, 1982. The subject patent is particularly directed to a cushioned needle work blocking board permitting the blocking and pressing of needle work. As disclosed therein, a dense fiberboard is provided with a overlay of a sponge-like cushioning material which in turn is secured within an outer cotton cover and enclosure. The top of the cover is imprinted with marking indicia for blocking and marking of the elements.

The rotary cutting mat and the quilt pressing boards have been formed and sold separately. Although this provides a satisfactory system, the components for quilting desirably are highly portable for the convenience of quilters who often work in groups and provide their own equipment for actual preparation and quilting. There is therefore always a continuing need for providing a quilting unit of a highly portable construction as well as providing for convenient storage, which is more readily and conveniently used by the quilter.

SUMMARY OF THE PRESENT INVENTION

The present invention is particularly directed to an integrated rotary cutting mat and cushioned pressing unit integrated into a single construction for convenient storage and portability.

Generally, in accordance with the teaching of this invention, a flat cutting mat is formed of a relatively thin material which has a generally soft surface for convenient cutting without surface destruction. The surface of the mat is provided with an appropriate marking grid as well as appropriate angled lines for assisting the user in cutting of the fabric into the desired shape and configuration and size. The cutting mat is provided with an extended handle structure consisting of an handle secured and spaced from one edge one surface of the cutting mat to define a hand opening. About the opening, divided guide markings are provided on the mat surface for further manipulation in marking of the fabric. The markings are placed on the opposite sides, and preferably about the periphery of the handle. In a preferred construction, the hand opening is an elongated slot of length substantially greater than required for hand gripping and consists of a pair of lateral parallel side edges and curved ends. The elongated edges provide a convenient guide edge for cutting of a fabric along a line by placing of the fabric on a cutting surface and then placing of the cutting mat over the fabric with the fabric exposed through the opening and with the edges exposed for cutting by using of a conventional cutting tool. The handle thus functions for marking or cutting fabric as well as a carrying or storage support. Similar markings can, of course, be provided on only one edge as shown or on the opposite side as well. The latter may interfere with the conventional edge grid markings of a rotary cutting mat.

A cushioned pressing board unit is intimately attached to the backside of the cutting mat. In the integrated unit with the mat handle, the pressing board unit is specially located adjacent but inwardly of the handle and the markings on the opening of the handle. The pressing unit has appropriate angle and bias lines as well as a separate overall grid with appropriate markings. The combination of the cutting mat with the integrated cushioned pressing board unit, particularly with the interconnected handle, provides a unique and practical unit for the quilting trade. The rotary cutting mat provides for a convenient support for the cushioned pressing unit and the total assembly can be stored and carried in convenient and effective manner.

In the preferred embodiment, the integrated assembly thus provides the advantages of a conventional cutting mat and a separate pressing board, while simultaneously providing the necessary interrelated indicia for the cutting of the cut elements and rapid pressing of the cut elements as required. The handle structure, particularly with the integrated markings, provides a significant improvement in a rotary cutting mat as such as well as in the total integrated unit.

BRIEF DESCRIPTION OF THE DRAWINGS

The drawing furnished herewith illustrates a preferred construction of the present invention in which the above advantages and features are clearly disclosed as well as others which will be readily understood from the description of the embodiments:

In the drawing:

FIG. 2 is a view of the backside of the unit shown in FIG. 1;

FIG. 4 is a cross sectional view of a portion of the board unit illustrating the internal detail of the construction.

DESCRIPTION OF THE ILLUSTRATED EMBODIMENT

Figure 1:
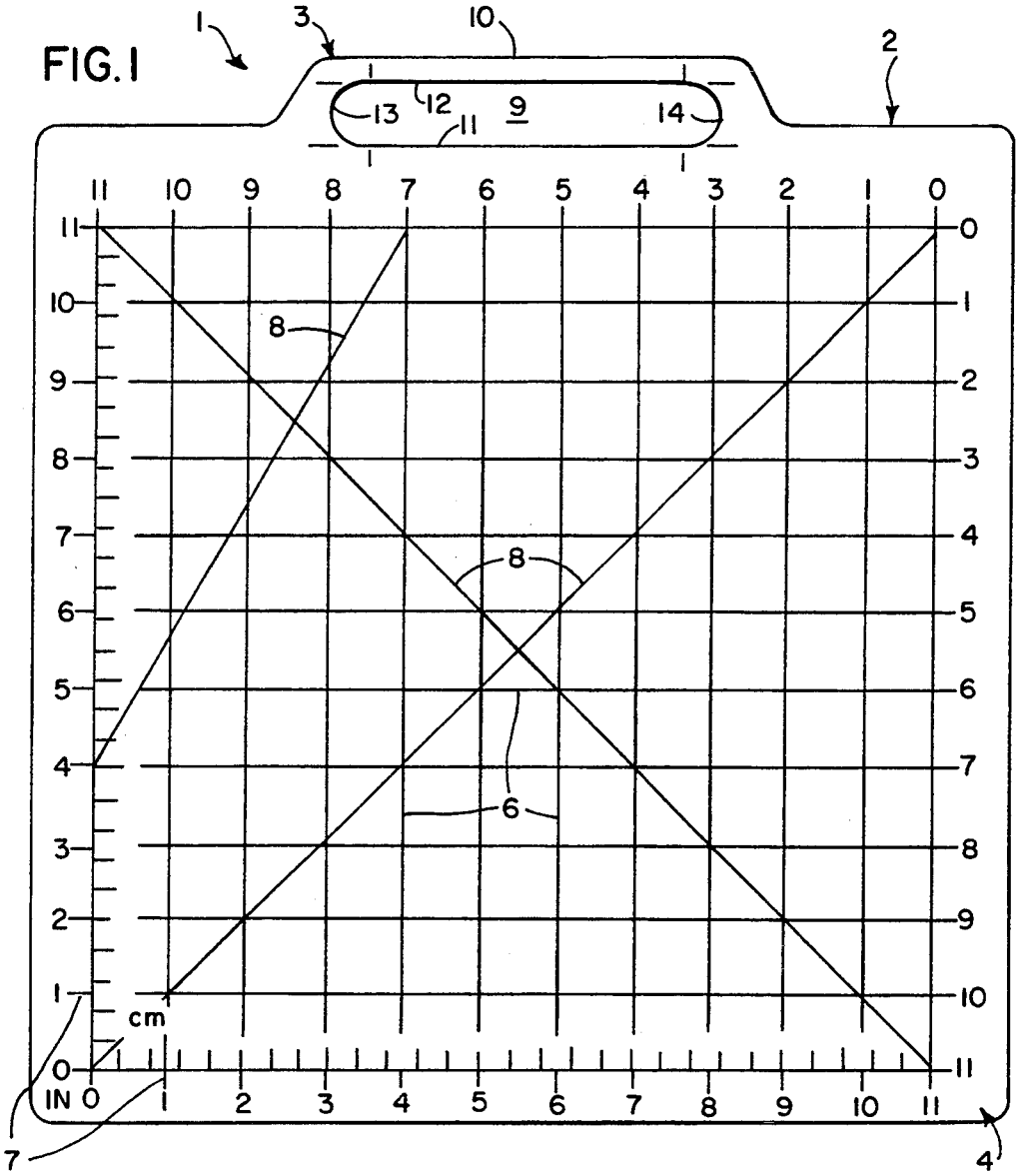
FIG. 1 is a plan view of the integrated cutting mat and pressing board unit illustrating an embodiment of the present invention.

Referring to the drawing and particularly to FIGS. 1 and 2, an integrated cutting mat and pressing board unit 1 is illustrated of a generally rectangular configuration. The integrated unit 1 includes a cutting mat 2 with a carrying handle unit 3 integrally formed on one edge. A pressing unit 4 is intimately secured to the backside of the cutting mat 2 and is of a substantially corresponding configuration with the exception of the edge 5 adjacent the handle unit 3, which is spaced inwardly of the handle unit 3.

The front or exposed face of the cutting mat 2 includes a grid work 6 divided in one inch squares with appropriate identifying divisional information or indicia 7 along all four sides of the grid pattern. Suitable bias lines 8 are also imprinted on the mat 2. The cutting mat 2 is formed of a relatively firm rigid material which will not buckle, crack or peel under normal usage. The rotary cutting mat must be placed on a relatively flat surface and is formed of a material which has exposed surface material which has some resiliency and does not readily cut such that the surface is not destroyed through the use of a conventional rotary quilting cutter. The mat 2 as such, of the above material and with grid pattern shown has been sold for a number of years and is a highly accepted mat in the field of domestic quilting.

Figure 3:
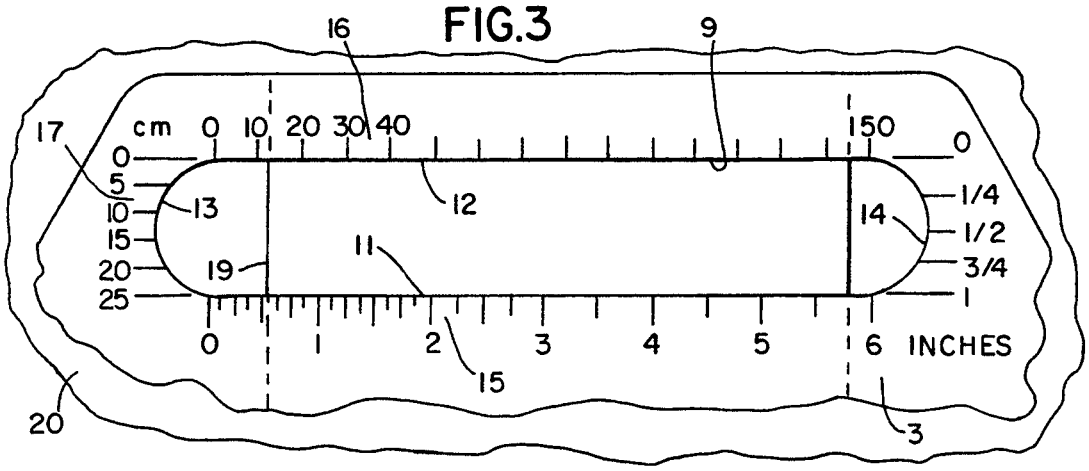
FIG. 3 is an enlarged fragmentary view illustrating the handle construction in the illustrated embodiment, as viewed from the pressing side of the board unit.

In the illustrated embodiment of the invention, the cutting mat 2 is provided with the handle unit 3 along the one edge, shown generally as the top edge. The illustrated handle structure or unit 3 formed by an extension of the central portion of the cutting mat 2, with an opening 9 provided in the cutting mat extension to form a convenient handle member 10 for carrying of the unit. The handle member 10 with the opening 9 is of a length slightly greater then six inches and with a depth of the opening equal to approximately one inch in a preferred construction. The length and size of the opening is thus greater than that required for convenient hand grasping and is specially provided to define an additional marking and cutting guide in the mat 2. In this aspect of the invention, as more particularly shown in FIG. 3, the opening 9 has parallel long edges 11 and 12 joined by curved end edges 13 and 14. Marking and cutting indicia are applied to the one face of mat 2, and as illustrated indicates an opening approximately six inches in length, with decimal indicia 15 in inches located on one long edge 11 of the opening and metric indicia 16 in centimeters on the opposite long edge 12. The depth of the opening is also increased to approximately one inch, with corresponding metric markings or indicia 17 on one end 13 and decimal markings or indicia 18 on the opposite end 14 of the opening 9. The markings can be applied to both faces of the mat 2, but in the illustrated embodiment of the invention are shown applied to the mat face or side carrying the cushioned pressing board unit 4. With this system, as shown in FIG. 3, the cutting mat 2 can be laid upon fabric 19 which is supported on another supporting surface 20, with the cushion unit 4 located as the exposed side or surface of the assembly. With the cutting mat 2 having marked opening 9 abutting the fabric 19, the fabric 19 can then be marked and/or actually cut along the edges 11-14 of the enlarged handle opening 9 for various small design control. In summary, the handle structure 3 of the present invention formed with the enlarged opening 9 and handle location, provides a convenient transport and storage element as well as an effective additional marking or cutting guide without significant or undesirable increasing the size or complexity of the integrated assembly.

The quilting pressing board unit 4 is intimately secured to the backside of the cutting mat 2. The unit 4 is a rectangular unit having a width generally equal to the width of the cutting mat and a depth or height less than the mat. The lower edges of the mat cutting mat 2 and the pressing board unit 4 are aligned. The upper edge 21 of the pressing board unit 4 is spaced inwardly of the upper edge of the cutting mat 2, and particularly the handle structure 3 to fully expose the handle opening 9 and adjacent indicia.

The cushioned pressing board unit 4 includes a relatively hard backing board 22 such as a pressed wood board. It is covered by a layer of foam material to form a resilient pad 23, such as disclosed in applicant's prior patent. An outer cover 24 of a fabric, preferably one hundred percent cotton, wraps about the edges of the board 22 and 23 and projects inwardly between the backing board 22 and the cutting mat 2. The addition of the pressing board unit 4 with the backing board 22 further strengthens and supports the cutting mat 2 to provide an effective planar surface for marking and cutting of material. The pressing board unit and the cutting mat are attached to each other along the interface by any suitable means or element, preferably by a suitable adhesive 25 to insure the continued interconnection throughout the interface, which establishes a long life assembly. The pressing board cover 24 has a grid and bias lines 26 corresponding to mat 2 as well as circle lines 27 spaced in accordance with the grid pattern.

The integrated unit is formed using present day technology and equipment similar to that heretofore used and combined and modified in a unique manner to produce the extremely convenient integral cutting and pressing unit for use, transport and storage. The integrated cutting and pressing unit is particularly adapted for domestic home users to create professional results.

Although the handle structure 3 is preferably formed as an extension of the mat, a similarly handle extension with the marking and cutting indicia may be attached to the board element of the pressing board unit within the broadest aspects of the invention. Similarly, the construction of the pressing board unit and the mat may be varied within the above teaching. Various modifications may of course be made within the scope of the invention which is particularly directed to the integration of the separate devices, with the additional multiple functional handle structure.

Various modes of carrying out the invention are contemplated as being within the scope of the following claims particularly pointing out and distinctly claiming the subject matter which is regarded as the invention.

I claim:

1. A cutting and pressing board unit for cutting, blocking and pressing of fabric in preparation of fabric parts for assembling of the same with other similar fabric parts, comprising a relatively flat cutting mat formed of a solid plastic and having a cutting face and a back face, said cutting surface including measuring indicia with related numerical identification of said measuring indicia, a cushioned pressing board unit interconnected to the back face of said cutting mat and including a support board secured abutting the mat and an outer resilient pad interconnected to said board and an outer cover enclosing said board and pad, said cover including a grid of measuring indicia with appropriate numerical identification of said last named measuring indicia.

2. The board unit of claim 1, wherein said board unit is adapted to be laid upon a substantially horizontal support surface with one of said cutting face and back face exposed, and including a handle structure extending outwardly from one edge of said mat and pressing board unit and from said indicia on said pad and said cutting mat, said handle structure including a handle opening including spaced edges, measuring indicia located about said edge of said handle opening, whereby said board unit when laying on said support surface with said handle opening upwardly exposed provides exposure of fabric beneath it for marking and/or cutting using said spaced edges of said opening as a guide.

3. The board unit of claim 2, wherein said cutting mat has parallel outer edges and said handle unit is formed as an extension of said cutting mat and said handle opening is within said cutting mat and spaced outwardly of said pressing board unit, said spaced edges of said handle opening including generally parallel edges parallel to said parallel outer edges of said cutting mat.

4. The unit of claim 2, wherein said handle opening has parallel edges of a linear extent of at least about six inches.

5. The unit of claim 4, wherein said handle opening has curved ends with marking indicia.

6. The unit of claim 5, wherein said curved ends are semi-circular.

7. The unit of claim 2, wherein said handle opening spaced edges are marked with metric measurements along a first edge and decimal measurements markings on the second edge, and including opposite end edges connecting said spaced edges, and metric measurement markings on one end edge and decimal measurement markings on the second end edge.

8. The board unit of claim 2, wherein said cutting face is formed of relatively soft material.

9. The board unit of claim 2, wherein said indicia on said cutting mat includes a grid pattern and bias lines extended in various directions.

10. The board unit of claim 1, wherein said outer cover is formed of a fabric extended over the outer surface of said pad and wrapped about the edges of said pad and said support board and interposed between the cutting mat and said support board.

11. The board unit of claim 1, wherein said cutting mat has a grid pattern with edge markings corresponding to decimal marking indicia on each edge and on at least two edges having markings in both decimal and metric measurement systems, said cutting mat having angled bias lines, said pressing board unit having a grid pattern with measurement markings on all four edges and a series of circular patterns spaced in accordance with said edge markings, said angled bias fines on said pressing board unit including bias lines corresponding to said bias lines on said cutting mat.

12. A cutting mat unit for preparation of fabric parts, comprising a relatively flat cutting mat formed of a solid plastic having an encircling edge and having a cutting face and a back face, wherein said board unit is adapted to be laid upon a substantially horizontal support surface with one of said cutting face and back face exposed, and said cutting face including measuring indicia with related numerical identification, a handle structure extending outwardly from said edge, said handle structure including a handle opening including extended edges forming an outwardly located extended handle along a part of the extended edges, said handle permitting hand grasping of the handle, measuring indicia located about said extended edges of said handle opening, whereby said cutting mat when laid on a support surface with said handle opening upwardly exposing said measuring indicia located about said opening provides exposure of fabric beneath the opening for marking and/or cutting using said extended edges of said handle opening as a guide.

13. The cutting mat unit of claim 12, wherein said extended edges of said handle opening include parallel edges of a substantially linear extent in excess required for grasping of the handle structure.

14. The cutting mat unit of claim 13, wherein said handle opening has curved ends with marking indicia.

15. The cutting mat unit of claim 14, wherein said curved ends are semi-circular.

16. The cutting mat unit of claim 13, wherein the extent of said linear edges is at least six inches and said linear edges are spaced by at least one inch.

17. The cutting mat unit of claim 13, wherein said extended edges are marked with metric measurements along one of said parallel edges, and decimal measurement markings on the other of said parallel edges, said parallel edges being connected by opposite end edges, said end edges including metric measurement marking on one of said edges and decimal measurement markings on the other of said end edges.

18. The board unit of claim 13, wherein said cutting face is formed of relatively soft material.

19. The board unit of claim 13, wherein said indicia on said cutting mat includes a grid pattern and bias lines extended in various directions.

* * * * *